United States Patent [19]

Kikuchi

[11] Patent Number: 4,474,148

[45] Date of Patent: Oct. 2, 1984

[54] INTERNAL COMBUSTION WITH BEARING BEAM STRUCTURE

[75] Inventor: Kazuhiro Kikuchi, Yokosuka, Japan

[73] Assignee: Nissan Motor Co., Ltd., Yokohama, Japan

[21] Appl. No.: 398,600

[22] Filed: Jul. 15, 1982

[30] Foreign Application Priority Data

Jul. 17, 1981 [JP] Japan ..... 56-105302[U]

[51] Int. Cl.[3] ..... F02F 7/00

[52] U.S. Cl. ..... 123/195 H; 123/195 R; 384/429

[58] Field of Search ..... 123/195 R, 195 C, 195 H, 123/198 E; 384/429, 432, 433; 308/179

[56] References Cited

U.S. PATENT DOCUMENTS 4,213,440 7/1980 Abe et al. ..... 123/198 E
4,230,087 10/1980 Abe et al. ..... 123/195 C

FOREIGN PATENT DOCUMENTS 472638 4/1967 Belgium .
56588 7/1982 European Pat. Off. .
2135632 12/1972 France .

OTHER PUBLICATIONS

Der Porsche-V8-Motor Typ 928; Schellmann et al.; 1977; 3 pages.

*Primary Examiner*—Craig R. Feinberg
*Assistant Examiner*—David A. Okonsky
*Attorney, Agent, or Firm*—Schwartz, Jeffery, Schwaab, Mack, Blumenthal & Koch

[57] ABSTRACT

An internal combustion engine comprises a cylinder block having at its bottom part a plurality of bearing sections; and a bearing beam structure including a plurality of main bearing cap sections each of which associates with the cylinder block bearing section to rotatably support a crankshaft, first and second beam sections for securely connecting all the bearing cap sections and extending parallel with the axis of the crankshaft, the distance between the outer-most side-surfaces of the first and second beam sections being equal to or smaller than the width of each bearing cap section, and at least four cap bolts for fastening each bearing cap section onto the cylinder block, thereby effectively suppressing the vibration of the bearing beam structure itself and accordingly the vibration of the lower part of the cylinder block.

6 Claims, 5 Drawing Figures

INTERNAL COMBUSTION WITH BEARING BEAM STRUCTURE

BACKGROUND OF THE INVENTION

1. Field of the Invention

This invention relates to a low-noise level automotive internal combustion engine, and more particularly to an engine equipped with a bearing beam structure for supporting a crankshaft.

2. Description of the Prior Art

One of the major sources of engine noise is vibration noise emitted from the cylinder block skirt or lower section and oil pan of the engine. This noise is caused by the vibration of the cylinder block. In order to reduce such vibration noise it would appear to be sufficient to suppress vibration due to explosion torque applied to the crankshaft by increasing the rigidity of the cylinder block. However, this unavoidably leads to an increase in cylinder block wall thickness and accordingly to a great increase in engine weight, thereby giving rise to new problems such as reduced fuel economy. In view of this, a variety of proposals have been made to improve the rigidity of the cylinder block while suppressing an increase in cylinder block weight. In these proposals, particular attention has been paid to the employment of a bearing beam structure which securely connects a plurality of bearing caps for directly supporting the crankshaft to improve the strength of bearing caps and engine parts associated therewith.

BRIEF SUMMARY OF THE INVENTION

An internal combustion engine according to the present invention comprises a cylinder block having at its bottom part a plurality of bearing sections for the journals of a crankshaft. A bearing beam structure is secured to the bottom part of the cylinder block and includes a plurality of main bearing cap sections a of which associates with each bearing section of the cylinder block so as to rotatably support the crankshaft journal. First and second beam sections are provided to securely connect all the bearing cap sections with each other. The first and second beam sections extend parallel with the axis of the crankshaft and are located spaced from each other. The distance between the outer-most side-surface of the first beam section and that of the second beam section is equal to or smaller than the width of each bearing cap section. Additionally, at least four cap bolts are used for fastening each bearing cap section onto the cylinder block.

By virtue of the high rigidity bearing beam structure and its secure connection with the cylinder block, the vibration of the main bearing bulkheads and the skirt section of the cylinder block can be effectively suppressed. Moreover, the wider bearing cap section arrangement increases the rigidity of the bearing beam structure itself and accordingly prevents the formation of a new vibration system, thereby achieving a further engine noise reduction.

BRIEF DESCRIPTION OF THE DRAWINGS

The features and advantages of the internal combustion engine according to the present invention will be more appreciated from the following description taken in conjunction with the accompanying drawings in which like reference numerals and characters designate like parts and elements, in which.

DETAILED DESCRIPTION OF THE INVENTION

Figure 1:
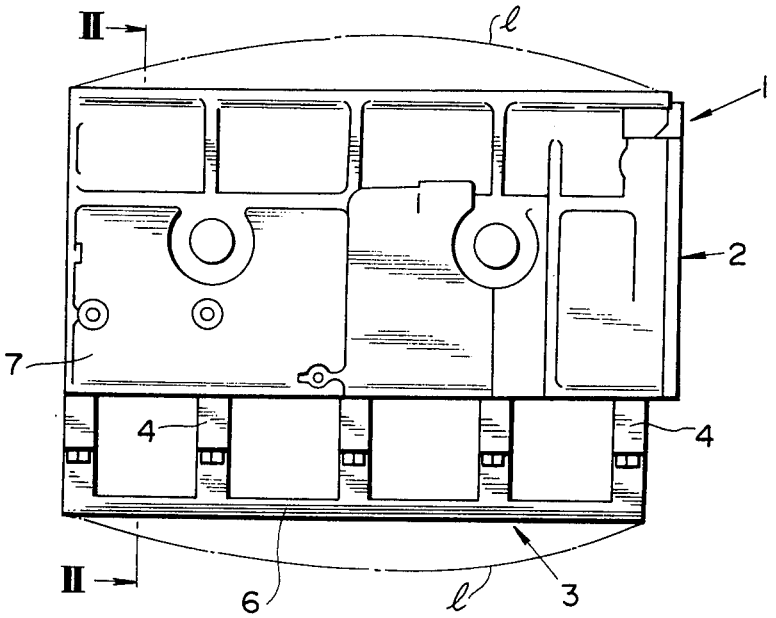
FIG.1 PRIOR ART
FIG. 1 is a front elevation of a conventional internal combustion engine.
Figure 2:
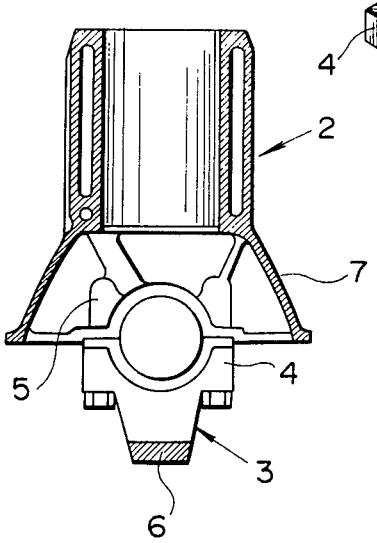
FIG.2 PRIOR ART
FIG. 2 is a vertical sectional view taken substantially along the line II—II of FIG. 1.
Figure 3:
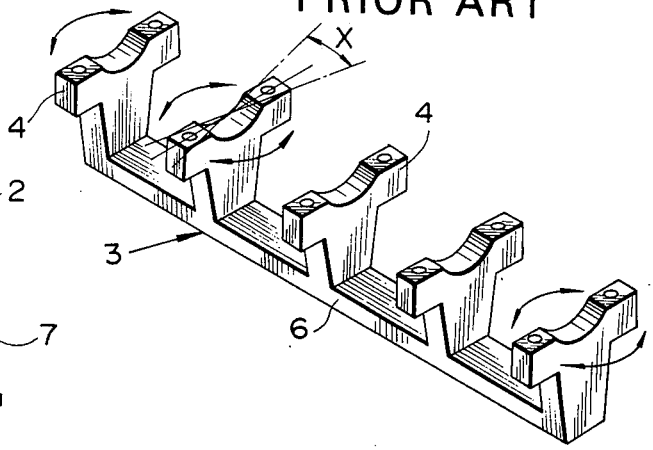
FIG.3 PRIOR ART
FIG. 3 is a perspective view of a conventional bearing beam structure used in the engine of FIG. 1.

To facilitate understanding the invention, brief reference will be made to an engine block 1 of a conventional automotive internal combustion engine, depicted in FIGS. 1 to 3. Referring to FIGS. 1 and 2, the engine block 1 includes a cylinder block 2, and a bearing beam structure 3 secured to the bottom part of the cylinder block 2 by means of bolts. The bearing beam structure 3 has a plurality of main bearing cap sections 4 one of the which associates with each of bearing sections 5 or main bearing bulkheads of the cylinder block 2, as shown in FIG. 3. The thus associated bearing cap sections 4 and cylinder block bearing sections 5 rotatably support the journal of a crankshaft (not shown). The bearing cap sections 4 are securely or integrally connected with each other through a beam section 6 extending along the axis of the crankshaft, so that the rigidity of the engine block 1 can be increased. Therefore, the engine block 1 is considerably improved in flexural rigidity against the flexural vibration indicated in phantom l in FIG. 1 and against the vibration of the bearing cap sections 4 in the axial direction of the crankshaft or the fore-and-aft direction which vibration so acts on each bearing cap section to cause it to come down.

However, with the above-mentioned arrangement, although the flexural rigidity of the engine block 1 is increased in the direction perpendicular to the crankshaft axis, a desired low level of engine noise cannot be attained because of a mere contribution to slightly raising the resonance frequency of the cylinder block in the vicinity of 1800 Hz.

Furthermore, even if each main bearing cap section 4 is prevented from vibrating in the fore-and-aft direction to cause it to come down, it is not effective for suppressing the vibration of a cylinder block skirt section 7, bulged outwardly to define thereinside the upper section of a crankcase (not identified), in the lateral direction or open-and-close movement direction. Accordingly, the above-mentioned arrangement is not so effective for preventing noise generation from the skirt section 7 and an oil pan (not shown) securely attached to the bottom edge of the skirt section 7. This has been confirmed by the applicants.

It has been revealed that the lateral vibration of the cylinder block skirt section 7 is induced by the movements of bearing cap sections 4 and the bearing bulkheads 5 due to their torsional vibration around the crankshaft axis and flexural vibration in the direction indicated by an arrow X in FIG. 3. Such movements are combined and excite the vibration of the cylinder block skirt section 7 and the oil pan with vibration frequencies ranging from about 800 to 1250 Hz. It will be appreciated from the above, that the above-mentioned conventional bearing beam structure 3 is not effective and therefore is low in noise reduction effect for a weight increase thereof.

Figure 4:
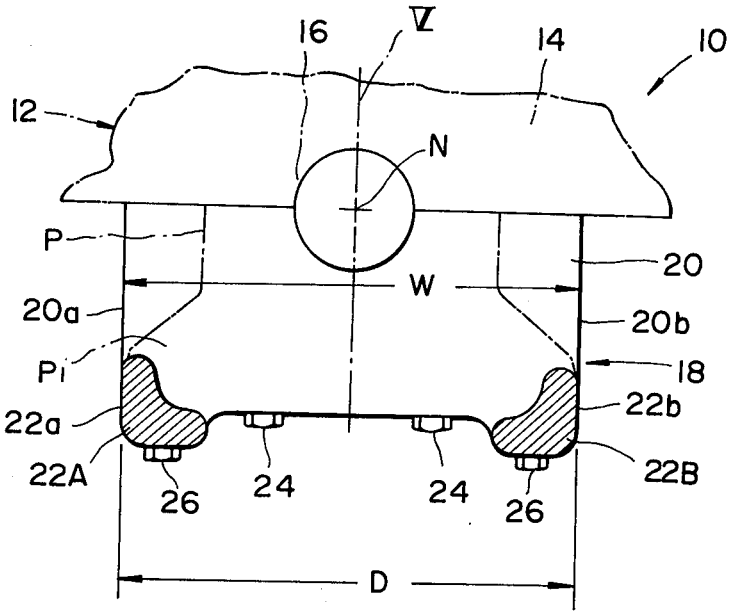
FIG. 4 is a vertical sectional view of an essential part of a preferred embodiment of an internal combustion engine in accordance with the present invention.
Figure 5:
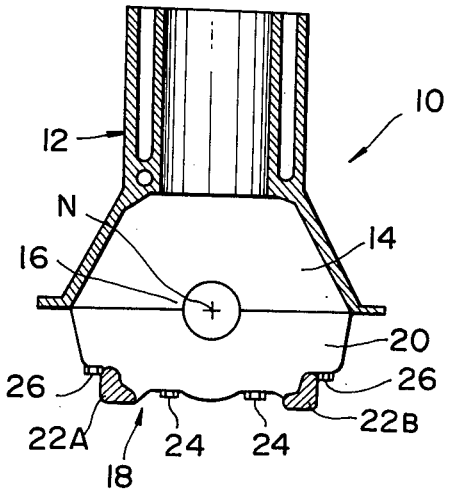
FIG. 5 is a vertical sectional view of another embodiment of the engine according to the present invention.

In view of the above description of an automotive engine provided with a conventional bearing beam structure, reference is now made to FIGS. 4 and 5, and more specifically to FIG. 4, wherein a preferred embodiment of an internal combustion engine of the present invention is illustrated by the reference numeral 10. The engine 10 comprises a cylinder block 12 which is, as usual, formed with a plurality of cylinder barrels (not shown) each defining therein a cylinder bore. The cylinder block 10 is further formed at its lower part with a so-called skirt section (not shown) which is integral with the cylinder barrels and bulged outwardly and laterally to define thereinside an upper part of a crankcase. A plurality of parallel disposed main bearing bulkheads 14 are formed integral with the cylinder barrels and with the skirt section. Each bearing bulkhead is located below the cylinder barrels and integrally connected to a portion between neighboring two cylinder barrels. Each bearing bulkhead 14 is formed with a bearing section 16 for the journal of a crankshaft (only its axis N is shown).

A bearing beam structure 18 is securely connected to the bottom part of the cylinder block 12 and includes a plurality of main bearing cap sections 20. Each bearing cap section 20 is rigidly attached onto one main bearing bulkhead 14 so as to rotatably support the journal of the crankshaft through main bearing metals (not shown) carried by the combined bearing section 16 and bearing cap section 20. The bearing cap sections 20 are integrally connected with each other through two elongated beam sections or members 22A, 22B which are located parallel with each other and with the crankshaft axis N. In this embodiment, each bearing cap section 20 is generally rectangular as viewed from the direction of the crankshaft axis N. In this connection, the two beam sections 22A, 22B are positioned respectively along the bottom opposite corners of the rectangular bearing cap sections 20. The two beam sections 22A, 22B are located generally symmetrical with respect to an imaginary vertical plane V containing the crankshaft axis N.

As shown, each rectangular bearing cap section 20 is formed with opposite side-surfaces **20*a*, 20*b* which are located generally symmetrical with respect to and parallel with the above-mentioned vertical plane V. It is to be noted that the width W of the bearing cap section 20 is equal to or larger than the distance D between the outer-most side-surfaces 22*a*, 22*b* of the two beam sections 22A, 22B. It will be understood that the beam sections 22A, 22B** are located sufficiently separate from each other so as to lie outside of the envelope (not shown) of the outer-most loci of the big end of a connecting rod (not shown) of the engine.

Two inner opposite cap bolts 24 are disposed to pierce the bearing cap section and threaded into the main bearing bulkhead 14. The cap bolts 24 are located generally symmetrical with respect to the vertical plane V. Additionally, two outer opposite cap bolts 26 are disposed outside of the inner cap bolts 24 to pierce the bearing cap section 20 and the beam sections 22A, 22B, respectively. The outer cap bolts 26 are threaded into the main bearing bulkhead 14.

With the thus arranged bearing beam structure 18, the bearing cap sections 20 are noticeably increased in strength against the downward vibration applied thereto in the direction of the crankshaft axis and in torsional strength in the direction around the crankshaft axis N. Furthermore, the bearing cap sections 20 are also increased in the flexural strength. As a result, the torsional and flexural vibrations of the bearing bulkhead 14 united with the bearing cap section 20 are greatly suppressed, thus effectively preventing the lateral or open-and-close movement vibration (membrane vibration) of the skirt section which is integrally connected to the bearing bulkheads 14. Therefore, the engine noise due to vibration of the cylinder block skirt section can be noticeably decreased, thereby greatly contributing to the total engine noise reduction.

Now, in order to sufficiently separate the two beam sections 22A, 22B from each other for the purpose of avoiding interference with a crank system containing the crankshaft and the large ends of the connecting rods, it would be possible to form each bearing cap section 20 into the shape indicated in phantom by dot-dash line P. This phantom bearing cap section P is formed with oppositely disposed connection sections $P_1$ which elongate outwardly and downwardly to be integrally connected to the beam sections 22A, 22B, in which the width of an upper part of the bearing cap section is considerably smaller than the distance D between the outer-most side-surfaces of the opposite beam sections 22A, 22B. However, with such a bearing cap section indicated in phantom P in FIG. 2, sufficient rigidity cannot be obtained for the elongated connecting sections $P_1$ and therefore the connection sections and the beam sections 22A, 22B tend to consitute a vibration system. This vibration system might cause the vibration of the cylinder block 12, thereby degrading noise reduction effect even upon employing the bearing beam structure 18 having the two oppositely disposed beam sections 22A, 22B.

In this regard, according to the present invention, the bearing cap sections 20 and the beam sections 22A, 22B are directly connected with each other without employing the above-mentioned connecting sections $P_1$. In addition, the number of the cap bolts 24, 26 is increased as compared with conventional bearing beam structures as shown in FIGS. 1 to 3. Therefore, a new vibration system cannot be formed in the bearing beam structure 18, thereby making the rigidity of the beam sections 22A, 22B sufficiently effective to suppress the vibration of the cylinder block 12. It will be appreciated that this greatly improves the vibration suppression effect of the cylinder block 12 over the above-mentioned alternative including the above-discussed phantom bearing cap sections P, thereby achieving a sufficient total engine noise reduction.

FIG. 5 illustrates another embodiment of the engine in accordance with the present invention. In this embodiment, each bearing cap section 20 is so formed that its width W is larger than that in FIG. 2, i.e., considerably larger than the distance D between the outer-most side-surfaces of the two beam sections 22A, 22B. Moreover, the outer cap bolts 26 are located outside of the respective beam sections 22A, 22B. Such location of the outer cap bolts 26 are preferable to obtain a further rigid connection between each bearing cap section 20 and the cylinder block 12, if it is not troublesome in an engine assembly process.

As appreciated from the above, according to the present invention, the width of each bearing cap section is made equal to or larger than the distance between the outer-most side-surfaces of the oppositely disposed beam sections, and therefore any connecting section for connecting the bearing cap section and the beam sections is not necessary, thereby preventing the formation of a new vibration system in the bearing beam structure. In addition, since the number of the cap bolts is increased as compared with in conventional engines, a sufficient rigid connection can be obtained between the bearing beam structure and the cylinder block so that the rigidity of the bearing beam structure directly and effectively acts on the cylinder block. This not only reduces the fore-and-aft vibration of each main bearing bulkhead and the open-and-close movement vibration of the cylinder block skirt section induced by the main bearing bulkhead vibration, but also lowers the level of resonance vibration in torsion and flexure of the cylinder block, thereby achieving a further noise reduction in automotive engines.

What is claimed is:

1. An internal combustion engine comprising:

a cylinder block having main bearing bulkheads which are respectively formed with bearing sections; and a bearing beam structure secured to a bottom part of said cylinder block and including:

a plurality of main bearing cap sections each of which associates with one bearing section of said cylinder block to rotatably support a journal of a crankshaft, first and second beam sections for securely connecting all said bearing cap sections with each other, said first and second beam sections extending parallel with an axis of the crankshaft and located spaced from each other and below the crankshaft, a distance between an outer-most side-surface of said first beam section and that of said second beam section being not greater than a width of each bearing cap section and smaller than a width of each main bearing bulkhead, the outer-most side-surface of each bearing section being spaced from a vertical plane containing an outer-most point of each main bearing bulkhead, and at least four bolts for fastening each bearing cap section onto said cylinder block, at least one of said bolts being located outside of a vertical plane containing an inner-most side-surface of each beam section.

2. An internal combustion engine as claimed in claim 1, wherein said first and second beam sections are located symmetrical with respect to the crankshaft axis.

3. An internal combustion engine as claimed in claim 1, wherein said at least four cap bolts include two inner cap bolts which are located inside of said first and second beam sections and symmetrical with respect to the crankshaft axis, and two outer cap bolts located outside of said inner cap bolts and symmetrical with respect to the crankshaft axis.

4. An internal combustion engine as claimed in claim 3, wherein said two outer cap bolts pierce said first and second beam sections, respectively.

5. An internal combustion engine as claimed in claim 3, wherein the width of each bearing cap section is larger than the distance between the outer-most side-surface of said first beam section and that of said second beam section.

6. an internal combustion engine as claimed in claim 5, wherein said two outer cap bolts are located outside of said first and second beam sections, respectively.

* * * * *

UNITED STATES PATENT AND TRADEMARK OFFICE

CERTIFICATE OF CORRECTION

PATENT NO. : 4,474,148

DATED : Oct. 2, 1984

INVENTOR(S) : Kazuhiro KIKUCHI

It is certified that error appears in the above—identified patent and that said Letters Patent is hereby corrected as shown below:

On the title page:

At item [54] TITLE: Kindly correct the title from "INTERNAL COMBUSTION WITH BEARING BEAM STRUCTURE" to -- INTERNAL COMBUSTION ENGINE WITH BEARING BEAM STRUCTURE --.

Signed and Sealed this

*Tenth* Day of *September 1985*

[SEAL]

*Attest:*

DONALD J. QUIGG

*Attesting Officer* *Acting Commissioner of Patents and Trademarks - Designate*